US009903592B2

(12) United States Patent
Weber et al.

(10) Patent No.: US 9,903,592 B2
(45) Date of Patent: Feb. 27, 2018

(54) OVEN MUFFLE WITH WELDING CONNECTION

(75) Inventors: Tobias Weber, Burk (DE); Christian Ehninger, Rothenburg o. d. Tauber (DE); Willi Kranz, Schnelldorf (DE); Bernd Heisswolf, Rothenburg o. d. Tauber (DE); Richard Wiesinger, Geslau (DE); Bernd Ebert, Geslau (DE)

(73) Assignee: Electrolux Home Products Corporation N. V., Brussels (BE)

( * ) Notice: Subject to any disclaimer, the term of this patent is extended or adjusted under 35 U.S.C. 154(b) by 683 days.

(21) Appl. No.: 13/805,734

(22) PCT Filed: Sep. 15, 2011

(86) PCT No.: PCT/EP2011/066007

§ 371 (c)(1),
(2), (4) Date: Sep. 30, 2013

(87) PCT Pub. No.: WO2012/041713

PCT Pub. Date: Apr. 5, 2012

(65) Prior Publication Data

US 2014/0014085 A1 Jan. 16, 2014

(30) Foreign Application Priority Data

Sep. 30, 2010 (EP) ..... 10011918

(51) Int. Cl.
*F24C 15/00* (2006.01)
*F24C 15/08* (2006.01)

(52) U.S. Cl.
CPC ..... *F24C 15/005* (2013.01); *F24C 15/08* (2013.01)

(58) Field of Classification Search
CPC ..... F24C 15/005; F24C 15/08; B23K 33/006; B23K 26/22; B23K 26/26; B23K 33/00
(Continued)

(56) References Cited

U.S. PATENT DOCUMENTS 2,037,962 A 4/1936 Brown
2,758,367 A * 8/1956 Dougherty ..... B65D 88/08 220/4.12

(Continued)

FOREIGN PATENT DOCUMENTS

DE 7441834 6/1976
DE 10314500 10/2004

(Continued)

OTHER PUBLICATIONS

International Search Report for PCT/EP2011/066007, dated Dec. 23, 2011, 2 pages.

(Continued)

*Primary Examiner* — Alfred Basichas
(74) *Attorney, Agent, or Firm* — Pearne & Gordon LLP

(57) ABSTRACT

The present invention relates to an Oven muffle (1), comprising at least a first metal sheet part (2) and a second metal sheet part (3) wherein the first metal sheet part and the second metal sheet part are arranged in an overlapping manner relative to each other, wherein the second metal sheet part comprises a portion (32) which is formed by a S-like or Z-like displacement of the second metal sheet part, and wherein the first metal sheet part and the second metal sheet part are connected by a welding seam at least in the overlapping region of first metal sheet part and second metal sheet part.

17 Claims, 1 Drawing Sheet

(58) Field of Classification Search
USPC ..... 126/19 R, 39 B, 273 R; 29/890.039
See application file for complete search history.

(56) References Cited

U.S. PATENT DOCUMENTS

| | | | | |
|---|---|---|---|---|
| 5,343,010 | A * | 8/1994 | Urech | B23K 26/26 219/105 |
| 2004/0255928 | A1 * | 12/2004 | Deubzer | F24C 15/08 126/273 R |

FOREIGN PATENT DOCUMENTS

| | | | | |
|---|---|---|---|---|
| DE | 102007051255 | | 5/2008 | |
| DE | 102007008772 | | 6/2008 | |
| EP | 0660048 | | 6/1995 | |
| JP | 2001293562 | A * | 10/2001 | B23K 9/00 |

OTHER PUBLICATIONS

Office Action in European Patent Application No. 10 011 918.9, dated Nov. 18, 2016, 10 pages.
Notice of Grant for EP application No. 10011918.9, dated Jul. 19, 2017, 23 pages.

* cited by examiner

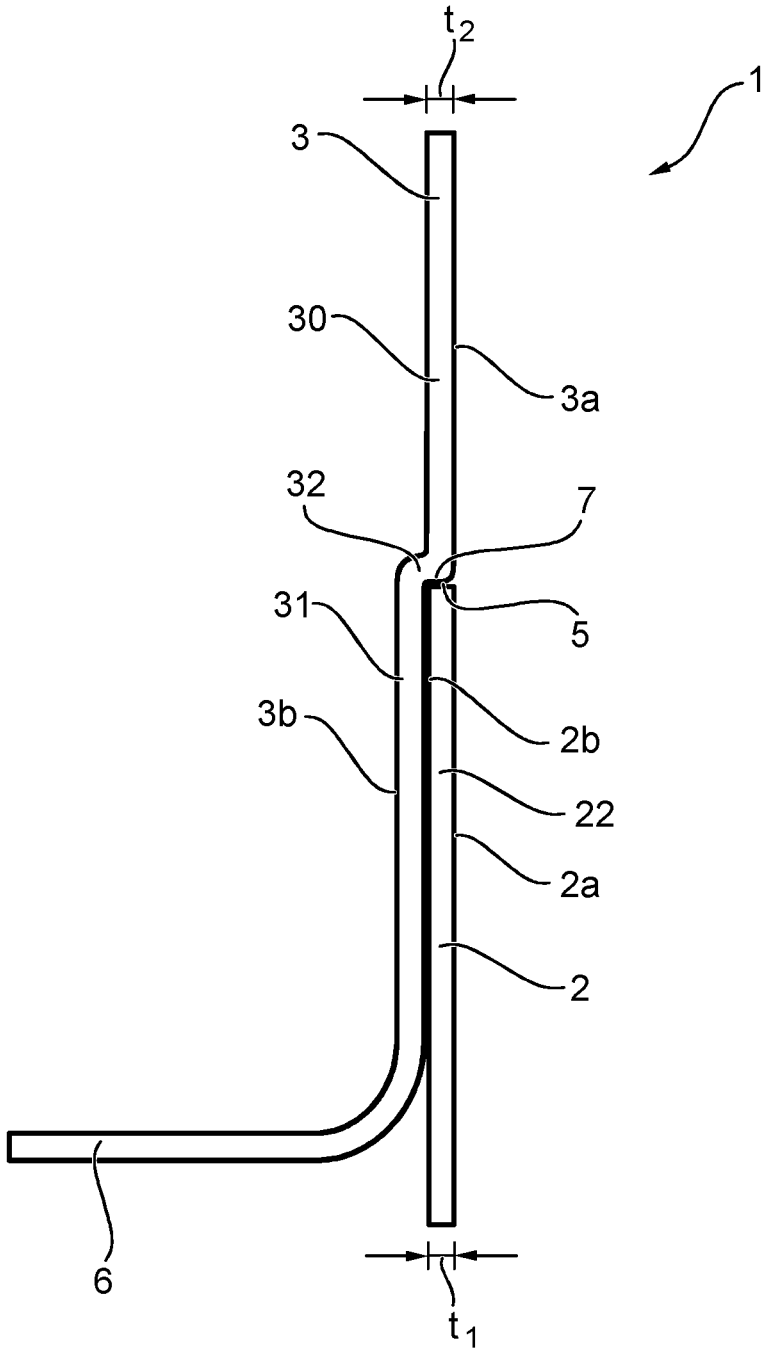
t2
1
3
30
3a
32
7
31
5
3b
2b
22
2a
2
6
t1

OVEN MUFFLE WITH WELDING CONNECTION

The present invention relates to an oven muffle with a welding connection.

EP 1 459 013 B1 describes a cooking appliance muffle, the inner side is coated with an enamel layer, in which muffle at least two metal plate ends are connected together by means of a weld seam, of which metal plate ends a first metal plate end at the inner side overlaps a second metal plate end at the outer side, which first metal plate end forms by its metal plate edge at the end face a step-like transition between the metal plate ends and the first metal plate end at the inner side is flattened in wedge shape in direction towards its metal plate edge at the end face prior to the welding.

DE 24 44 684 B1 describes a connected body made from two metal sheet parts which are connected non-detachable at overlapping sections wherein the overlapping sections are provided with an enamel coating. One of the overlapping metal sheet parts comprises a crimp which forms a wall in front the end of the other metal sheet parts which prevents that coating material flows off and which forms a capillary gap wherein coating material is kept.

An object of the present invention is to provide an oven muffle with advantageous properties.

A solution of this object according to the invention is defined and characterized by independent claim 1. The dependent claims refer to further embodiments of the present invention.

An oven muffle according to the present invention comprises at least a first metal sheet part and a second metal sheet part wherein the first metal sheet part and the second metal sheet part are arranged in an overlapping manner relative to each other, the first metal sheet part comprising a first surface and the second metal sheet part comprising a first surface which first surfaces are coated by a protective layer, in particular by an enamel coating, wherein the second metal sheet part comprises a portion which is formed by a S-like or Z-like displacement of the second metal sheet part and which is provided with a transition surface and wherein the first metal sheet part and the second metal sheet part form a joint such that the transition surface and a front end of the first metal sheet part are arranged adjacent, in particular in contact, to each other, and wherein the first metal sheet part and the second metal sheet part are connected by a welding seam at least in the overlapping region of first metal sheet part and second metal sheet part, in particular in the region of the joint of transition surface and front end and wherein the first surface of the first metal sheet part and the first surface of the second metal sheet part form together a substantially planar and even surface, at least in the region of the joint of transition surface and front end.

Advantageously an arrangement of two metal sheet parts for a welding connection is created, such that a joint is formed which comprises a planar and even surface. By means of such an arrangement a high quality of the surface having an enamel coating is possible. Each unevenness of the enameled surface is a potential contact point for filth. Because any unevenness is avoided, the cleaning of the oven muffle is relieved, filth cannot adhere to any steps or protruding structures of the welding connection on the interior surface of the oven muffle. A planar and even surface with optically and haptically perceptible smoothness is provided, evoking positive impressions and a sense of quality for a user.

In a further embodiment of the invention the length of the transition surface corresponds to the thickness $t_1$ of the first metal sheet part and/or is as long as the thickness $t_1$ of the first metal sheet part.

An adaption of the length of the transition surface to the thickness $t_1$ of the first metal sheet part allows an dimensioning of the welding connection.

In a further embodiment of the invention the transition surface extends along the complete front end of the first metal sheet part.

Thus, the possible contact surface between transition surface and front end is maximised. Good quality of the welding connection is provided.

In a further embodiment of the invention the joint is a closed joint or the joint comprises a gap of less than 1 mm width.

A closed joint or a joint with a gap of less than 1 mm width allows to provide an optimized enamel coating on the surface, that can be perceived as a planar and even surface.

In a further embodiment of the invention the thickness $t_1$ of the first metal sheet part and the thickness $t_2$ of the second metal sheet part are substantially identical.

The dimensioning of the welding connection for the oven muffle is simplified, when parts of the same material thickness are used.

In another embodiment of the invention the thickness $t_1$ of the first metal sheet part is smaller than the thickness $t_2$ of the second metal sheet part. In particular the thickness $t_1$ 0.5 mm and the thickness $t_2$ 0.6 mm.

Such an arrangement allows to reduce the dimensions of the S-like or Z-like displacement and to provide a flushing and even surface. Furthermore it is preferred to use metal sheets with thicknesses as small as possible.

In a further embodiment of the invention the welding seam is a spot welding seam or a continuous welding seam.

It is an advantage that the quality of the surface of the welding connection is independent from the kind of welding seam.

In a further embodiment of the invention the second metal sheet part extends in the overlapping region parallel to the first metal sheet part and/or that the second metal sheet part comprises a bending and forms a flange which projects in a 90° angle from the first metal sheet part.

A parallel extension of the both metal sheet parts in the overlapping region allows a larger potential surface for the welding seam to be provided. Further a flange might be used for attaching additional parts to the muffle.

In a further embodiment of the invention the first surface of the first metal sheet part and the first surface of the second metal sheet part form an interior surface of the oven muffle.

Thus, the enameled surface forms an interior surface of the oven muffle comprising a high quality.

FIG. 1 illustrates a sectional view of a metal sheet connection for an oven muffle according to the invention;

The oven muffle 1 comprises a first metal sheet part 2 and a second metal sheet part 3. The first metal sheet part 2 comprises a first surface 2*a* and a second surface 2*b* and the second metal sheet part 3 comprises a first surface 3*a* and a second surface 3*b* and the metal sheet parts 2, 3 are arranged in an overlapping manner relative to each other in such a way that the second surface 2*b* of the first metal sheet part 2 is in touch, in particular over a large planar and/or longitudinal extension, with the first surface 3*a* of the second metal sheet part 3. The metal sheet connection 1 is adapted e.g. for the connection of parts of an oven muffle to form a cooking chamber. For forming a cooking chamber the first surface 2*a* of the first metal sheet part 2 and the first surface

3*a* of the second metal sheet part 3 form a part of the interior surface of the cooking chamber. Usually the inner surface of the cooking chamber is coated with enamel or other appropriate coating material for the protection of the metal sheet parts and for relieving the cleaning process. The second surface 3*b* of the second metal sheet part 3 and at least a part of the second surface 2*b* of the first metal sheet part 2 form an exterior surface of the oven muffle. The second metal sheet part 3 comprises a portion 32 which divides the second metal sheet part 3 into at least a first section 30 and a second section 31. The portion 32 is formed by a S-like or Z-like displacement of the second metal sheet part 3. The first section 30 and the second section 31 extend parallel to each other and are displaced relative to each other by the thickness $t_1$ of the first metal sheet part 2 which is in FIG. 1 identical to the thickness $t_2$ of the second metal sheet part 3. Of course, it is possible that thickness $t_1$ and $t_2$ differ from each other. In particular it is possible that $t_1$ is smaller than $t_2$. By means of the displacement a transition surface 7 is formed on the portion 32. The first metal sheet part 2 comprises a front section 22 which terminates in a front end 5 of the first metal sheet part 2.

The first metal sheet part 2 and the second metal sheet part 3 are arranged such that at least the front section 22 partially overlaps the second section 31 of the second metal sheet part 3. The front end 5 of the first metal sheet part 2 is arranged adjacent to the transition surface 7 of the second metal sheet 3. Thus, the first metal sheet part 2 which is in an overlapping position to the second metal sheet part 3 and having the front end 5 being adjacent to the transition surface 7 of the second metal sheet part 3 fits exactly so that the first metal sheet 2*a* and first surface of the second metal sheet 3*a* form a planar and even surface with optically and haptically perceptible smoothness. The first metal sheet part 2 and the second metal sheet part 3 abut on each other in that a the first surface 2*a* of the first metal sheet part 2 and the second surface 3*a* of the second metal sheet part 3 are flushing with each other. This is achieved in particular when the transition surface 7 corresponds or is as long as the thickness $t_1$ of the first metal sheet part 2. Thus, metal sheet parts with different thicknesses can be used, wherein the transition surface 7 is adaptable to the thickness $t_1$ of the first metal sheet part 2 by adapting the dimensions of the S-like or Z-like displacement of the second metal sheet part 3.

Preferredly transition surface 7 and front end 5 are in contact to each other and form a closed joint, but also a gap between transition surface 7 and front end 5 is possible. The gap shall not be larger than 1 mm.

A welding seam, in particular a spot welding seam or a continuous welding seam, is provided in the region of the joint of transition surface 7 and front end 5. In particular the joint itself forms or is a part of the welding seam.

The second metal sheet part 3 extends in the overlapping region parallel to the first metal sheet part 2. At the end of the overlapping region the second metal sheet part 3 comprises a bending and forms a flange 6 which projects in a 90° angle away from the first metal sheet part 2.

LIST OF REFERENCE NUMERALS

1 Oven muffle
2 first metal sheet part
2*a* first surface of the first metal sheet part
2*b* second surface of the first metal sheet part
22 front section
3 second metal sheet part
3*a* first surface of the second metal sheet part
3*b* second surface of the second metal sheet part
30 first section of the portion
31 second section of the portion
32 portion
5 front end
6 flange
7 transition surface
$t_1$ thickness of the first metal sheet part
$t_2$ thickness of the second metal sheet part

The invention claimed is:

1. Oven muffle (1), comprising at least a first metal sheet part (2) and a second metal sheet part (3) wherein the first metal sheet part (2) and the second metal sheet part (3) are arranged in an overlapping manner relative to each other, the first metal sheet part (2) comprising a first surface (2*a*) and the second metal sheet part (3) comprising a first surface (3*a*) which first surfaces (2*a*, 3*a*) are coated by an enamel coating, wherein the second metal sheet part (3) comprises a portion (32) which is formed by a S-like or Z-like displacement of the second metal sheet part (3) and which is provided with a transition surface (7), wherein the first metal sheet part (2) and the second metal sheet part (3) form a joint such that the transition surface (7) and a front end (5) of the first metal sheet part (2) are arranged parallel and in contact with each other, wherein the first metal sheet part (2) and the second metal sheet part (3) are connected by a welding seam at least in the overlapping region of first metal sheet part (2) and second metal sheet part (3), wherein the first surface (2*a*) of the first metal sheet part (2) and the first surface (3*a*) of the second metal sheet part (3) form together a substantially planar and even surface, at least in the region of the joint of transition surface (7) and front end (5), wherein a thickness $t_1$ of the first metal sheet part (2) is smaller than a thickness $t_2$ of the second metal sheet part (3), and wherein the second metal sheet part (3) comprises a first section (30) and a second section (31) that are offset from each other and extend parallel to each other, the transition surface (7) of the second metal sheet part (3) being between and continuous with the first section (30) and second section (31).

2. The oven muffle according to claim 1, wherein the length of the transition surface (7) is as long as the thickness $t_1$ of the first metal sheet part (2).

3. The oven muffle according to claim 1, wherein the transition surface (7) extends along an entirety of the front end (5) of the first metal sheet part (2).

4. The oven muffle according to claim 1, wherein the welding seam is a spot welding seam or a continuous welding seam.

5. The oven muffle according to claim 1, wherein the second metal sheet part (3) extends in the overlapping region parallel to the first metal sheet part (2).

6. The oven muffle according to claim 1, wherein the first surface (2*a*) of the first metal sheet part (2) and the first surface (3*a*) of the second metal sheet part (3) form an interior surface of the oven muffle.

7. The oven muffle according to claim 1, wherein the length of the transition surface (7) corresponds to the thickness $t_1$ of the first metal sheet part (2).

8. The oven muffle according to claim 1, wherein the thickness $t_1$=0.5 mm and the thickness $t_2$=0.6 mm.

9. The oven muffle according to claim 1, wherein said welding seam is in the region of the joint of transition surface (7) and front end (5).

10. The oven muffle according to claim 1, wherein the joint between the transition surface (7) and the front end (5) of the first metal sheet part (2) is a closed joint.

11. The oven muffle according to claim 1, wherein the substantially planar and even surface formed by the first metal sheet part (2) and the second metal sheet part (3) is an interior surface of a cooking chamber.

12. The oven muffle according to claim 11, wherein the second metal sheet part (3) comprises a bending and forms a flange (6) which projects in a 90° angle from the first metal sheet part (2).

13. The oven muffle according to claim 12, wherein the substantially planar and even surface formed by the first metal sheet part (2) and the second metal sheet part (3) faces a first direction and the flange (6) projects from the first metal sheet part (2) in a second direction opposite to the first direction.

14. Oven muffle (1), comprising at least a first metal sheet part (2) and a second metal sheet part (3) wherein the first metal sheet part (2) and the second metal sheet part (3) are arranged in an overlapping manner relative to each other, the first metal sheet part (2) comprising a first surface (2*a*) and the second metal sheet part (3) comprising a first surface (3*a*) which first surfaces (2*a*, 3*a*) are coated by an enamel coating, wherein the second metal sheet part (3) comprises a portion (32) which is formed by a S-like or Z-like displacement of the second metal sheet part (3) and which is provided with a transition surface (7), wherein the first metal sheet part (2) and the second metal sheet part (3) form a joint such that the transition surface (7) and a front end (5) of the first metal sheet part (2) are arranged in parallel and adjacent to each other, wherein the first metal sheet part (2) and the second metal sheet part (3) are connected by a welding seam at least in the overlapping region of first metal sheet part (2) and second metal sheet part (3), wherein the first surface (2*a*) of the first metal sheet part (2) and the first surface (3*a*) of the second metal sheet part (3) form together a substantially planar and even surface that is an interior surface of a cooking chamber, at least in the region of the joint of transition surface (7) and front end (5), wherein a thickness $t_1$ of the first metal sheet part (2) is smaller than a thickness $t_2$ of the second metal sheet part (3), wherein the joint comprises a gap of less than 1 mm width, wherein the second metal sheet part (3) comprises a first section (30) and a second section (31) that are offset from each other and extend parallel to each other, the transition surface (7) of the second metal sheet part (3) being between and continuous with the first section (30) and second section (31).

15. The oven muffle according to claim 14, wherein the gap is provided between the transition surface (7) and the front end (5) of the first metal sheet part (2).

16. The oven muffle according to claim 14, wherein the second metal sheet part (3) comprises a bending and forms a flange (6) which projects in a 90° angle from the first metal sheet part (2).

17. The oven muffle according to claim 16, wherein the substantially planar and even surface formed by the first metal sheet part (2) and the second metal sheet part (3) faces a first direction and the flange (6) projects from the first metal sheet part (2) in a second direction opposite to the first direction.

* * * * *